US008181634B2

(12) United States Patent
Spix et al.

(10) Patent No.: US 8,181,634 B2
(45) Date of Patent: May 22, 2012

(54) ENGINE INCLUDING POSITIVE CRANKCASE VENTILATION

(75) Inventors: Thomas A. Spix, Rochester Hills, MI (US); Manmeet S. Pannu, Sterling Heights, MI (US); Kevin Roussey, Ortonville, MI (US)

(73) Assignee: GM Global Technology Operations LLC

( * ) Notice: Subject to any disclaimer, the term of this patent is extended or adjusted under 35 U.S.C. 154(b) by 0 days.

(21) Appl. No.: 12/914,332

(22) Filed: Oct. 28, 2010

(65) Prior Publication Data

US 2011/0277733 A1 Nov. 17, 2011

Related U.S. Application Data

(60) Provisional application No. 61/345,350, filed on May 17, 2010.

(51) Int. Cl.
*F02M 25/06* (2006.01)

(52) U.S. Cl. ..... 123/572

(58) Field of Classification Search ..... 123/572–574, 123/41.86, 559.1–559.3
See application file for complete search history.

(56) References Cited

U.S. PATENT DOCUMENTS

| | | | | |
|---|---|---|---|---|
| 4,607,604 | A * | 8/1986 | Kanoh et al. | 123/572 |
| 4,760,833 | A * | 8/1988 | Tatyrek | 123/574 |
| 6,530,367 | B2 * | 3/2003 | Akiwa et al. | 123/572 |
| 7,775,198 | B2 * | 8/2010 | Shieh | 123/574 |
| 2001/0022175 | A1 * | 9/2001 | Moren | 123/572 |
| 2002/0046743 | A1 * | 4/2002 | Moren | 123/572 |
| 2010/0077999 | A1 * | 4/2010 | Okada | 123/572 |
| 2010/0101514 | A1 * | 4/2010 | Hirano et al. | 123/41.86 |
| 2010/0269803 | A1 * | 10/2010 | Iwata | 123/572 |

* cited by examiner

*Primary Examiner* — M. McMahon
(74) *Attorney, Agent, or Firm* — Harness, Dickey & Pierce, P.L.C.

(57) ABSTRACT

An engine assembly may include an engine structure, an intake assembly and a cylinder head cover assembly. The engine structure may define a combustion chamber and a crankcase in communication with a fresh air supply. The intake assembly may be in communication with the combustion chamber. The cylinder head cover assembly may be fixed to the engine structure and may include a cover member defining a positive crankcase ventilation chamber and a separator coupled to the cover member. The separator may define an inlet providing communication between the crankcase and the positive crankcase ventilation chamber. The cylinder head cover assembly may include a first outlet flow path in communication with the intake assembly and a second outlet flow path in communication with the intake assembly. A first valve may be located in the first outlet flow path.

12 Claims, 4 Drawing Sheets

ENGINE INCLUDING POSITIVE CRANKCASE VENTILATION

CROSS-REFERENCE TO RELATED APPLICATIONS

This application claims the benefit of U.S. Provisional Application No. 61/345,350, filed on May 17, 2010. The entire disclosure of the above application is incorporated herein by reference.

FIELD

The present disclosure relates to engine positive crankcase ventilation systems.

BACKGROUND

This section provides background information related to the present disclosure which is not necessarily prior art.

Internal combustion engines may combust a mixture of air and fuel in cylinders and thereby produce drive torque. A portion of the combustion gases (blowby) may escape the combustion chamber past the piston and enter the engine crankcase. Crankcase ventilation systems may be incorporated into engines in order to mitigate the effects of blowby gases in the crankcase.

SUMMARY

An engine assembly may include an engine structure, an intake assembly and a cylinder head cover assembly. The engine structure may define a combustion chamber and a crankcase in communication with a fresh air supply. The intake assembly may be in communication with the combustion chamber. The cylinder head cover assembly may be fixed to the engine structure and may include a cover member defining a positive crankcase ventilation chamber and a separator coupled to the cover member. The separator may define an inlet providing communication between the crankcase and the positive crankcase ventilation chamber. The cylinder head cover assembly may include a first outlet flow path in communication with a first region of the intake assembly and a second outlet flow path in communication with a second region of the intake assembly. A first valve may be located in the first outlet flow path.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
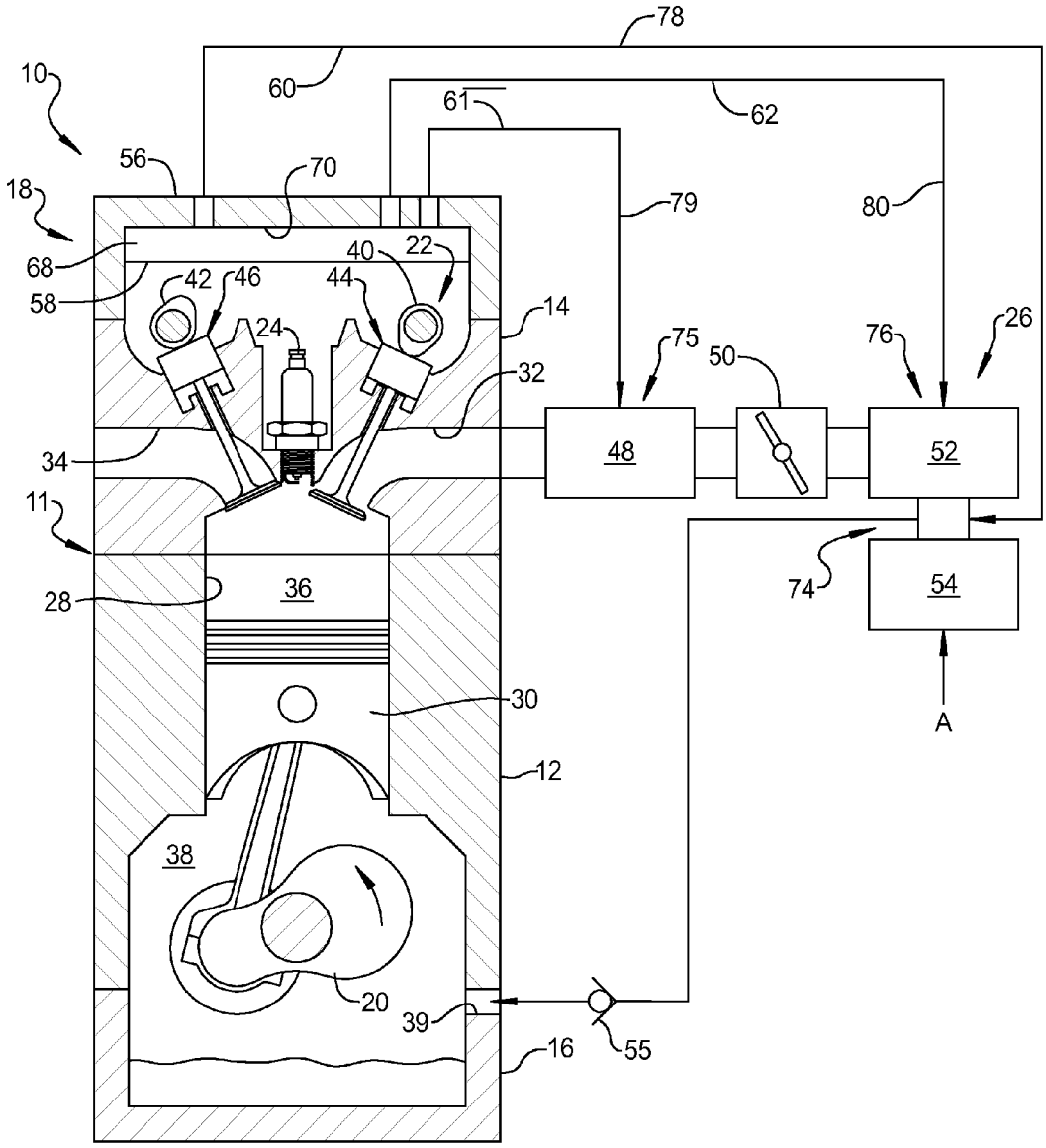
FIG. 1 is a schematic illustration of an engine assembly according to the present disclosure.

An engine assembly is schematically illustrated in FIG. 1 and may include engine structure 11 defined by an engine block 12 and a cylinder head 14, an oil pan 16, an engine cylinder head cover assembly 18, a crankshaft 20, a valvetrain assembly 22, a spark plug 24, a fuel system (not shown), and an engine intake assembly 26. The engine block 12 may define cylinder bores 28 (one of which is shown), each having a piston 30 disposed therein. It is understood that the present teachings apply to any number of piston-cylinder arrangements and a variety of engine configurations including, but not limited to, V-engines, inline engines, and horizontally opposed engines, as well as both overhead cam and cam-in-block configurations.

The cylinder head 14 may include intake and exhaust passages 32, 34. The engine structure 11 may define a combustion chamber 36 and an engine crankcase 38 in communication with a fresh air supply (A). More specifically, the engine block 12, cylinder head 14, and piston 30 may cooperate to define the combustion chamber 36. The intake passage 32 may form an air inlet into the combustion chamber 36 and the exhaust passage 34 may form an exhaust gas outlet from the combustion chamber 36.

The crankcase 38 may be in communication with the fresh air supply (A) via a flow path 39. The flow path 39 may be in communication with the fresh air supply (A) via the intake assembly 26 or another engine component such as an oil dipstick tube (not shown). The flow path 39 may be in communication with a clean air supply via the intake assembly 26 as discussed below. The spark plug 24 may be located in the cylinder head 14 and may extend into the combustion chamber 36. The oil pan 16 may be coupled to the engine block 12 and may retain oil within the engine assembly 10. The engine block 12 and the oil pan 16 may cooperate to define the engine crankcase 38.

The valvetrain assembly 22 may be supported by the cylinder head 14 and may include intake and exhaust camshafts 40, 42 and intake and exhaust valve assemblies 44, 46. The intake camshaft 40 may be engaged with the intake valve assembly 44 and the exhaust camshaft 42 may be engaged with the exhaust valve assembly 46.

The intake assembly 26 may be in communication with the combustion chamber 36 and a fresh air supply (A). The intake assembly 26 may be in communication with the combustion chamber 36 via the intake passage 32 in the cylinder head 14. The fresh air supply (A) may include ambient air. The intake assembly 26 may include an intake manifold 48, a throttle 50, a compressor 52 (e.g., a turbocharger) and an air cleaner 54. The throttle 50 may be in communication with the intake manifold 48 and may selectively control air flow into the intake manifold 48.

The air cleaner 54 may be in communication with and located upstream of the throttle 50, defining an inlet for the intake assembly 26. The flow path 39 may be in communication with the intake assembly 26 at a location downstream of the air cleaner 54. Therefore, the flow path 39 may be in communication with a clean air supply. A check valve 55 may prevent flow from the engine crankcase 38 to the clean air region of the intake assembly 26. The compressor 52 may be in communication with and located between the throttle 50 and the air cleaner 54. While illustrated as having a compressor 52, it is understood that the present disclosure applies equally to arrangements that do not include a compressor 52.

Figure 2:
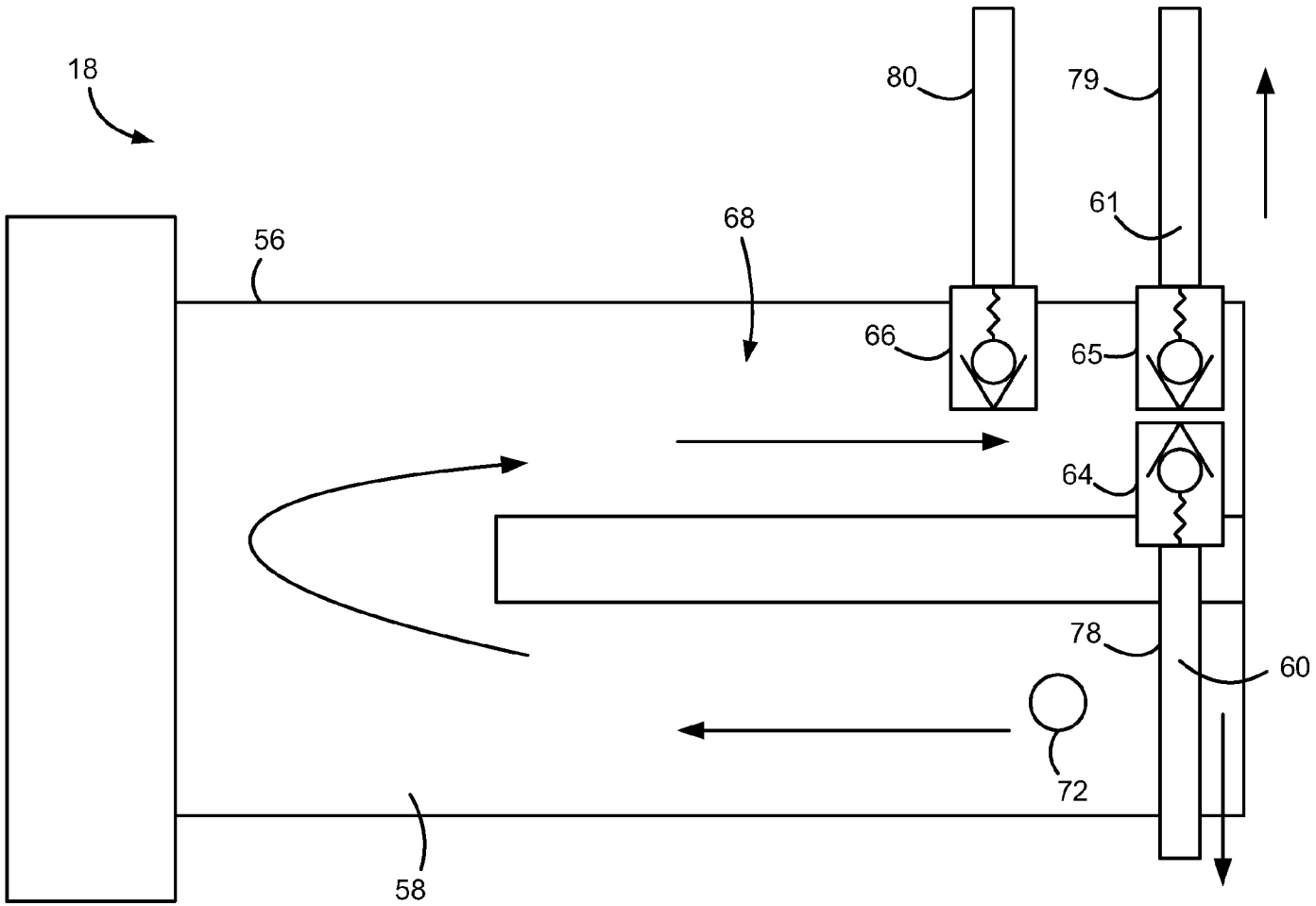
FIG. 2 is a schematic illustration of the cylinder head cover assembly shown in the engine assembly of FIG. 1.

With additional reference to FIG. 2, the cylinder head cover assembly 18 may be fixed to the engine structure 11 and may include a cover member 56, a separator 58 coupled to the cover member 56, a first outlet flow path 60, a second outlet flow path 61, a third outlet flow path 62, a first valve 64 located in the first outlet flow path 60, a second valve 65 located in the second outlet flow path 61 and a third valve 66 located in the third outlet flow path 62. The cover member 56 may define a positive crankcase ventilation chamber 68. More specifically, the separator 58 may be located within a cavity 70 defined by the cover member 56 and may cooperate with the cover member 56 to define the positive crankcase ventilation chamber 68. The positive crankcase ventilation chamber 68 may form an air-oil separator.

The separator 58 may define an inlet 72 providing communication between the crankcase 38 and the positive crankcase ventilation chamber 68. The first outlet flow path 60 may be in communication with a first region 74 of the intake assembly 26 and the positive crankcase ventilation chamber 68. The second outlet flow path 61 may be in communication with a second region 75 of the intake assembly 26 and the positive crankcase ventilation chamber 68. The third outlet flow path 62 may be in communication with a third region 76 of the intake assembly 26 and the positive crankcase ventilation chamber 68.

The first region 74 of the intake assembly 26 may be defined upstream of the throttle 50. More specifically, the first region 74 may be defined between the air cleaner 54 and the throttle 50. The intake manifold 48 may form the second region 75 of the intake assembly 26. In the present non-limiting example, the compressor 52 defines the third region 76 of the intake assembly 26.

A first conduit 78 may be in communication with the positive crankcase ventilation chamber 68 and the first region 74 of the intake assembly 26. More specifically, the first conduit 78 may extend from the positive crankcase ventilation chamber 68 to the first region 74 of the intake assembly 26. The first conduit 78 may define the first outlet flow path 60. A second conduit 79 may be in communication with the positive crankcase ventilation chamber 68 and the second region 75 of the intake assembly 26. More specifically, the second conduit 79 may extend from the positive crankcase ventilation chamber 68 to the second region 75 of the intake assembly 26. The second conduit 79 may define the second outlet flow path 61. A third conduit 80 may be in communication with the positive crankcase ventilation chamber 68 and the third region 76 of the intake assembly 26. More specifically, the third conduit 80 may extend from the positive crankcase ventilation chamber 68 to the third region 76 of the intake assembly 26. The third conduit 80 may define the third outlet flow path 62.

The first valve 64 may be located on the cover member 56, the second valve 66 may be located on the cover member 56 and the third valve 66 may be located on the cover member 56. By way of non-limiting example, the first, second and third valves 64, 65, 66 may be coupled directly to the cover member 56. Alternatively, the first, second and third valves 64, 65, 66 may be indirectly coupled to the cover member 56 while still being located adjacent the cover member 56.

The first valve 64 may control flow from the positive crankcase ventilation chamber 68 to a location upstream of the throttle 50 (first region 74). The second valve 65 may control flow from the positive crankcase ventilation chamber 68 to the intake manifold 48 (second region 75). The third valve 66 may control flow from the positive crankcase ventilation chamber 68 to intake manifold 48 (third region 76).

The first, second and third valves 64, 65, 66 may form mechanical valves opened by a pressure differential. By way of non-limiting example, the first, second and third valves 64, 65, 66 may form check valves. The first valve 64 may prevent flow from the intake assembly 26 to the positive crankcase ventilation chamber 68 via the first conduit 78, the second valve 65 may prevent flow from the intake assembly 26 to the positive crankcase ventilation chamber 68 via the second conduit 79 and the third valve 66 may prevent flow from the intake assembly 26 to the positive crankcase ventilation chamber 68 via the third conduit 80.

Figure 3:
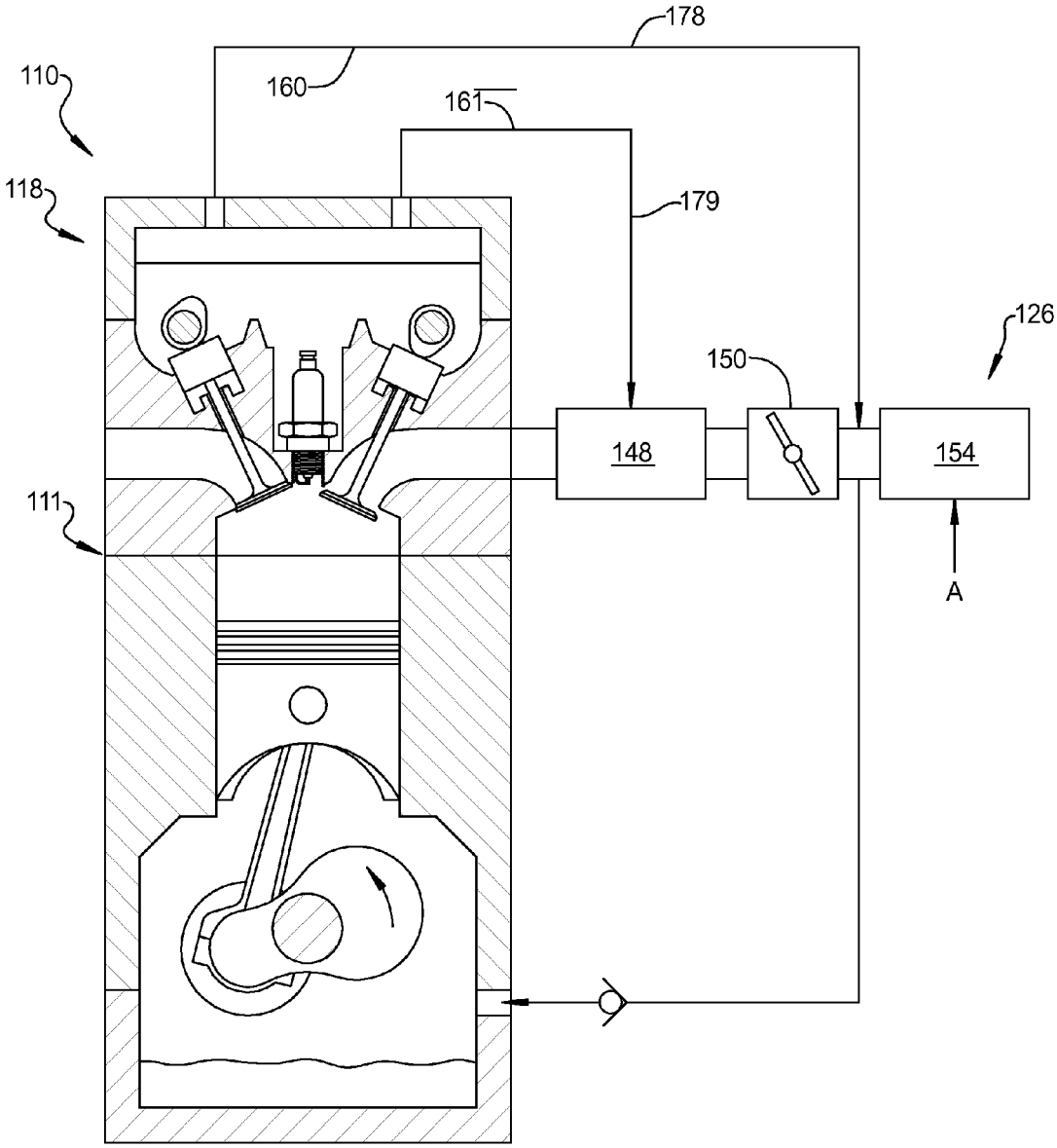
FIG. 3 is a schematic illustration of an alternate engine assembly according to the present disclosure.

An alternate engine assembly 110 without a compressor is shown in FIG. 3. The engine assembly 110 may be similar to the engine assembly 10 shown in FIG. 1 with the exceptions noted below. However, the engine assembly 110 may be a naturally aspirated engine assembly (no compressor). The intake assembly 126 in the arrangement of FIG. 3 may include an intake manifold 148, a throttle 150 and an air cleaner 154. The throttle 150 may be in communication with the intake manifold 148 and may selectively control air flow into the intake manifold 148. The air cleaner 154 may be in communication with and located upstream of the throttle 150, defining an inlet for the intake assembly 126.

Figure 4:
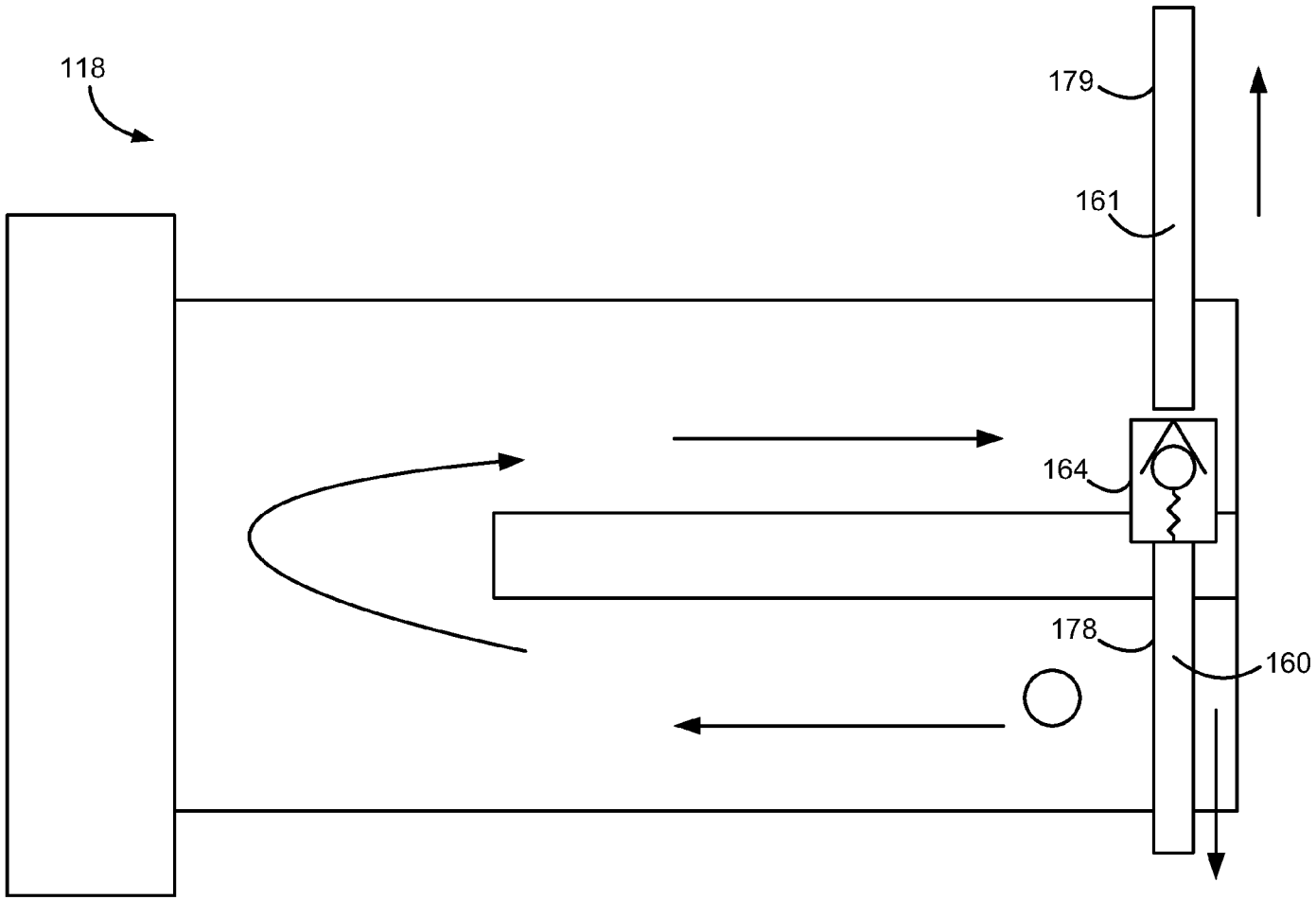
FIG. 4 is a schematic illustration of the cylinder head cover assembly shown in the engine assembly of FIG. 3.

With additional reference to FIG. 4, the cylinder head cover assembly 118 may be fixed to the engine structure 111 shown in FIG. 3. The cylinder head cover assembly 118 may be similar to the cylinder head cover assembly 18 shown in FIG. 2. However, the cylinder head cover assembly 118 may include first and second conduits 178, 179 defining the first and second outlet flow paths 160, 161 and a first valve 164 (without the third conduit 80 and the second and third valves 65, 66 shown in FIG. 2).

What is claimed is:

1. An engine assembly comprising:

an engine structure defining a combustion chamber and a crankcase in communication with a fresh air supply;

an intake assembly in communication with the combustion chamber and including:

an intake manifold;

a throttle in communication with the intake manifold and selectively controlling air flow into the intake manifold;

an air cleaner in communication with and located upstream of the throttle, a first region of the intake assembly being defined upstream of the throttle between the air cleaner and the throttle, the intake manifold forming a second region of the intake assembly; and a compressor in communication with and located between the throttle and the air cleaner and defining a third region of the intake assembly; and a cylinder head cover assembly fixed to the engine structure and including a cover member defining a positive crankcase ventilation chamber, a separator coupled to the cover member and defining an inlet providing communication between the crankcase and the positive crankcase ventilation chamber, a first outlet flow path in communication with the first region of the intake assembly and the positive crankcase ventilation chamber, a second outlet flow path in communication with the second region of the intake assembly and the positive crankcase ventilation chamber, and a first valve located in the first outlet flow path, the cylinder head cover assembly defining a third outlet flow path in communication with the third region of the intake assembly and the positive crankcase ventilation chamber.

2. The engine assembly of claim 1, wherein a first conduit extending from the positive crankcase ventilation chamber to the first region of the intake assembly defines the first outlet flow path and a second conduit extending from the positive crankcase ventilation chamber to the second region of the intake assembly defines the second outlet flow path.

3. The engine assembly of claim 1, wherein the first valve is located on the cover member.

4. The engine assembly of claim 3, further comprising a second valve located in the second outlet flow path and located on the cover member.

5. The engine assembly of claim 1, wherein the first valve is a mechanical valve opened by a pressure differential.

6. The engine assembly of claim 5, wherein the first valve forms a check valve.

7. An engine cylinder head cover assembly comprising:

a cover member defining a positive crankcase ventilation chamber;

a separator coupled to the cover member and defining an inlet providing communication between an engine crankcase and the positive crankcase ventilation chamber;

a first conduit extending from the positive crankcase ventilation chamber to a first region of an engine intake assembly defined at a location upstream of a throttle in the engine intake assembly and between an air cleaner in the engine intake assembly and the throttle, the first conduit defining a first outlet flow path in communication with the first region of the engine intake assembly and the positive crankcase ventilation chamber;

a second conduit extending from the positive crankcase ventilation chamber to a second region of the engine intake assembly, the second conduit defining a second outlet flow path in communication with the second region of the engine intake assembly and the positive crankcase ventilation chamber;

a first valve located in the first outlet flow path; and a third conduit extending from the positive crankcase ventilation chamber to a compressor in the engine intake assembly.

8. The engine cylinder head cover assembly of claim 7, wherein the second conduit extends from the positive crankcase ventilation chamber to an intake manifold of the engine intake assembly.

9. The engine cylinder head cover assembly of claim 7, wherein the first valve is located on the cover member.

10. The engine cylinder head cover assembly of claim 9, further comprising a second valve located in the second outlet flow path and located on the cover member.

11. The engine cylinder head cover assembly of claim 7, wherein the first valve is a mechanical valve opened by a pressure differential.

12. The engine cylinder head cover assembly of claim 11, wherein the first valve forms a check valve.

* * * * *